US010434530B2

(12) United States Patent
Furutani et al.

(10) Patent No.: US 10,434,530 B2
(45) Date of Patent: Oct. 8, 2019

(54) TRIGGER SPRAYER

(71) Applicant: CANYON CORPORATION, Tokyo (JP)

(72) Inventors: Tomichika Furutani, Sanyo Onoda (JP); Neil Michael Ryan, County Antrim (GB); David Rangel, County Antrim (GB)

(73) Assignee: CANYON CORPORATION, Tokyo (JP)

( * ) Notice: Subject to any disclaimer, the term of this patent is extended or adjusted under 35 U.S.C. 154(b) by 0 days.

(21) Appl. No.: 15/741,201

(22) PCT Filed: Jun. 22, 2016

(86) PCT No.: PCT/JP2016/003023
§ 371 (c)(1),
(2) Date: Dec. 29, 2017

(87) PCT Pub. No.: WO2017/002334
PCT Pub. Date: Jan. 5, 2017

(65) Prior Publication Data

US 2018/0193860 A1 Jul. 12, 2018

(30) Foreign Application Priority Data

Jul. 1, 2015 (JP) ..... 2015-133133

(51) Int. Cl.
*B05B 11/00* (2006.01)

(52) U.S. Cl.
CPC ..... *B05B 11/3016* (2013.01); *B05B 11/0064* (2013.01); *B05B 11/3009* (2013.01);
(Continued)

(58) Field of Classification Search
CPC ..... B05B 11/0016; B05B 11/3077; B05B 11/3074; B05B 11/0064; B05B 11/3009;
(Continued)

(56) References Cited

U.S. PATENT DOCUMENTS 5,628,434 A * 5/1997 Foster ..... B05B 11/0016 222/383.1
5,711,461 A * 1/1998 Foster ..... B05B 11/0016 222/383.1
(Continued)

FOREIGN PATENT DOCUMENTS

JP 52-80112 U 6/1977
JP 8-84945 A 4/1996
(Continued)

OTHER PUBLICATIONS

International Search Report from corresponding PCT application No. PCT/JP2016/003023.

*Primary Examiner* — Charles Cheyney
(74) *Attorney, Agent, or Firm* — Muncy, Geissler, Olds & Lowe, P.C.

(57) ABSTRACT

[Object] To provide a trigger sprayer including a valve through which liquid flows with very high efficiency.
[Solution] The present invention is directed to a trigger sprayer for, in a state of being attached to a container, causing liquid inside the container to be sprayed from a nozzle part 3 through a passage by rotating a trigger part to move a piston part 5 to apply pressure to liquid inside a cylinder portion 42A of a cylinder structure 4, including: an F valve 2 provided in a passage between the cylinder portion 42A and the container; and an S valve 1 provided in a passage section between the cylinder portion 42A and the nozzle part 3, wherein the S valve 1 includes a first valve body 11 and a first valve seat 12, the first valve body 11 is oppressed against the first valve seat 12, and when the first
(Continued)

valve body 11 moves away from the first valve seat 12 so that the S valve 1 opens, the first valve body 11 moves in the same direction as the direction that the liquid flows.

3 Claims, 11 Drawing Sheets

(52) U.S. Cl.
CPC ..... *B05B 11/3011* (2013.01); *B05B 11/3038* (2013.01); *B05B 11/3063* (2013.01); *B05B 11/3067* (2013.01); *B05B 11/3069* (2013.01)

(58) Field of Classification Search
CPC ..... B05B 11/3011; B05B 11/3016; B05B 11/3038; B05B 11/3063; B05B 11/3067; B05B 11/3069; B05B 11/0044
USPC ..... 222/383.1
See application file for complete search history.

(56) References Cited

U.S. PATENT DOCUMENTS

| | | | | |
|---|---|---|---|---|
| 7,175,056 | B2 * | 2/2007 | Buti | B05B 11/3011 222/340 |
| 8,684,235 | B2 * | 4/2014 | Inaba | B05B 11/0029 222/153.13 |
| 8,714,415 | B2 * | 5/2014 | Rech | B05B 11/0059 222/376 |
| 8,887,967 | B2 * | 11/2014 | Alluigi | B05B 11/3011 222/383.1 |
| 9,808,819 | B2 * | 11/2017 | Tada | B05B 11/0016 |

FOREIGN PATENT DOCUMENTS

| | | |
|---|---|---|
| JP | 2013-158673 A | 8/2013 |
| JP | 2014-028345 A | 2/2014 |
| WO | 2013/080538 A1 | 6/2013 |

* cited by examiner

TRIGGER SPRAYER

TECHNICAL FIELD

The present invention relates to trigger sprayers and, more in particular, to a trigger sprayer including an S valve through which liquid flows without hindrance and as efficiently as possible.

BACKGROUND ART

Conventionally, there has been widespread use of trigger sprayers as pieces of equipment that are attached to containers for causing liquid inside the containers to be ejected or sprayed.

In principle, such a trigger sprayer includes a piston and a cylinder and causes liquid inside the cylinder to be sprayed through a nozzle by moving the piston to apply pressure to the liquid.

Such trigger sprayers are classified into several types according to how their pistons move.

These types include, for example, a type of trigger sprayer whose trigger, provided in front, is pulled backward with a finger (see PTL 1).

Moving the trigger backward by squeezing it with a hand causes the piston to be depressed in step with the movement of the trigger to raise the pressure of liquid inside the cylinder.

This in turn causes the liquid to be sprayed with force through a nozzle part.

Further, there has been proposed a type of trigger sprayer including a main body and a trigger disposed above the main body, wherein liquid inside a cylinder is pressurized by pressing in a back end of the trigger downward and depressing a piston in step with the movement of the trigger.

Such a trigger sprayer includes an F valve on an upstream side of a passage and an S valve on a downstream side.

Specifically, the F valve is provided in a passage between a cylinder portion and a container, and the S valve is provided in a passage section between the cylinder portion and a nozzle part.

Liquid inside the container is pulled up into a cylinder through this F valve, and when pressurized, the liquid once pulled up into the cylinder is sent to the nozzle part through the S valve to be squirted out.

Incidentally, a conventional S valve 100 has not necessarily attained satisfaction from the point of view of the efficiency with which liquid flows.

FIG. 9 is an enlarged sectional view of a structure in the vicinity of an S valve in an example of a conventional trigger sprayer.

The S valve 100 includes a rod-like valve body 110 and a spinner 120, with a valve seat 121 supported by a back end of the spinner 120.

At normal times, the rod-like valve body 110 has its shoulder 111 brought into elastic contact with the valve seat 121 by a spring 130.

Application of pressure to the liquid causes the rod-like valve body 110 to move back against spring force, so that an interstice develops between the shoulder 111 and the valve seat 121.

After the S valve 100 has thus opened, the liquid flows downstream (toward a nozzle part) through this interstice.

However, whereas the liquid flows forward (downstream), the rod-like valve body 110 moves backward (upstream).

Therefore, since the liquid flows in a direction opposite to the direction that the rod-like valve body 110 moves, this constitutes a hindrance to the downward flow of the liquid, thus decreasing the efficiency with which the liquid flows.

This also adversely affects the efficiency with which the liquid squirts.

CITATION LIST

Patent literature

PTL 1: Japanese Patent Application Laid-Open No. 8-84945

SUMMARY OF INVENTION

Technical Problem

The present invention has been made on the basis of such background art and has as an object to provide a trigger sprayer including a valve through which liquid flows with very high efficiency.

Solution to Problems

The inventors diligently studied to solve the foregoing problems and found that the foregoing problems can be solved by changing the structure of a valve body 11 of an S valve 1.

That is, the present invention is directed to (1) a trigger sprayer A for, in a state of being attached to a container, causing liquid inside the container to be sprayed from a nozzle part 3 through a passage by rotating a trigger part to move a piston part 5 to apply pressure to liquid inside a cylinder portion 42A of a cylinder structure 4, including: an F valve 2 provided in a passage between the cylinder portion 42A and the container; and an S valve 1 provided in a passage section between the cylinder portion 42A and the nozzle part 3, wherein the S valve 1 includes a first valve body 11 and a first valve seat 12, the first valve body 11 is elastically pressed against the first valve seat 12, and when the first valve body 11 moves away from the first valve seat 12 so that the S valve 1 opens, the first valve body 11 moves in the same direction as the direction that the liquid flows.

That is, the present invention is directed to (2) the trigger sprayer A according to (1), wherein the first valve body 11 of the S valve 1 has a passage hole extending in a central axial direction, and the liquid flows through the passage hole.

That is, the present invention is directed to (3) the trigger sprayer A according to (2), wherein the first valve body 11 includes a small-diameter cylindrical part 11A and a large-diameter cylindrical part 11B coupled to an outer side of the small-diameter cylindrical part 11A via a connecting part, the small-diameter cylindrical part 11A has a gradually-expanded thin-walled increasing diameter portion formed at a tip thereof, and the large-diameter cylindrical part 11B has two flange portions.

That is, the present invention is directed to (4) the trigger sprayer A according to (1), wherein the cylinder structure 4 is provided with a columnar hole 42B inside which a standing cylindrical portion 71 of an attachment base part 7 that is attachable to the container via a cap 9 is attached, and the first valve seat 12 is formed at an upper end of the attachment base part 7.

That is, the present invention is directed to (5) the trigger sprayer A according to (3), wherein a hanging cylindrical portion is formed at an upper end of the columnar hole 42B of the cylinder structure 4 in a hanging manner, the increasing diameter portion of the first valve body 11 of the S valve 1 is in slide contact with an inner circumference of this hanging cylindrical portion, the flange portions of the first valve body 11 of the S valve 1 are in slide contact with an inner circumferential surface of the standing cylindrical portion 71 of the attachment base part 7, and a coil spring 13 that elastically presses the first valve body 11 downward is fitted on a circumference of the handing cylindrical portion.

That is, the present invention is directed to (6) the trigger sprayer A according to (1), wherein the F valve 2 is provided at a bottom of the cylinder portion 42A and opens by being pressed by the piston part 5.

That is, the present invention is directed to (7) the trigger sprayer A according to (6), wherein the F valve 2 includes a second valve body 21 and a second valve seat 22 formed at the bottom of the cylinder portion 42A, and the second valve body 21 has an inclined surface 21A serving as a contact surface that is pressed by the piston part 5.

It should be noted that a configuration based on a proper combination of configurations of the inventions described above can be employed, provided such a configuration fits the purpose of the present invention.

Advantageous Effects of Invention

The trigger sprayer A according to the present invention brings about the following effects:

1) The S valve 1 includes a first valve body 11 and a first valve seat 12, the first valve body 11 is oppressed against the first valve seat 12, and when the first valve body 11 moves away from the first valve seat 12 so that the S valve 1 opens, the first valve body 11 moves in the same direction as the direction that the liquid flows. This allows the liquid to flow through the valve with very high efficiency.

2) The first valve body 11 of the S valve 1 has a passage hole extending in a central axial direction, and the liquid flows through the passage hole. This minimizes horizontal oscillation of the first valve body 11. This makes it possible to perform a stable slide movement.

3) The first valve body 11 includes a small-diameter cylindrical part 11A and a large-diameter cylindrical part 11B coupled to an outer side of the small-diameter cylindrical part 11A via a connecting part, the small-diameter cylindrical part 11A has a gradually-expanded thin-walled increasing diameter portion formed at a tip thereof, and the large-diameter cylindrical part 11B has two flange portions. This allows the first valve body 11 to perform a stable slide movement.

4) The cylinder structure 4 is provided with a columnar hole 42B inside which a standing cylindrical portion 71 of an attachment base part 7 that is attachable to the container via a cap 9 is attached, and the first valve seat 12 is formed at an upper end of the attachment base part 7. This makes it possible to easily place the first valve seat 12.

5) A hanging cylindrical portion is formed at an upper end of the columnar hole 42B of the cylinder structure 4 in a hanging manner, the increasing diameter portion of the first valve body 11 of the S valve 1 is in slide contact with an inner circumference of this hanging cylindrical portion, the flange portions of the first valve body 11 of the S valve 1 are in slide contact with an inner circumferential surface of the standing cylindrical portion 71 of the attachment base part 7, and a coil spring 13 that oppresses the first valve body 11 downward is fitted on a circumference of the handing cylindrical portion. This makes it possible to easily place the S valve 1.

6) The F valve 2 is provided at a bottom of the cylinder portion 42A and opens by being pressed by the piston part 5. Therefore, the air inside the cylinder portion can be easily purged by an "air shot" at the stage of first use (where the cylinder portion 42A does not have liquid inside but has air inside).

7) The F valve 2 includes a second valve body 21 and a second valve seat 22 formed at the bottom of the cylinder portion 42A, and the second valve body 21 has an inclined surface 21A serving as a contact surface that is pressed by the piston part 5. This makes it possible to open the valve efficiently by utilizing the movement of the piston part 5.

DESCRIPTION OF EMBODIMENTS

A trigger sprayer A according to an embodiment of the present invention is described below with reference to the drawings.

Figure 1:
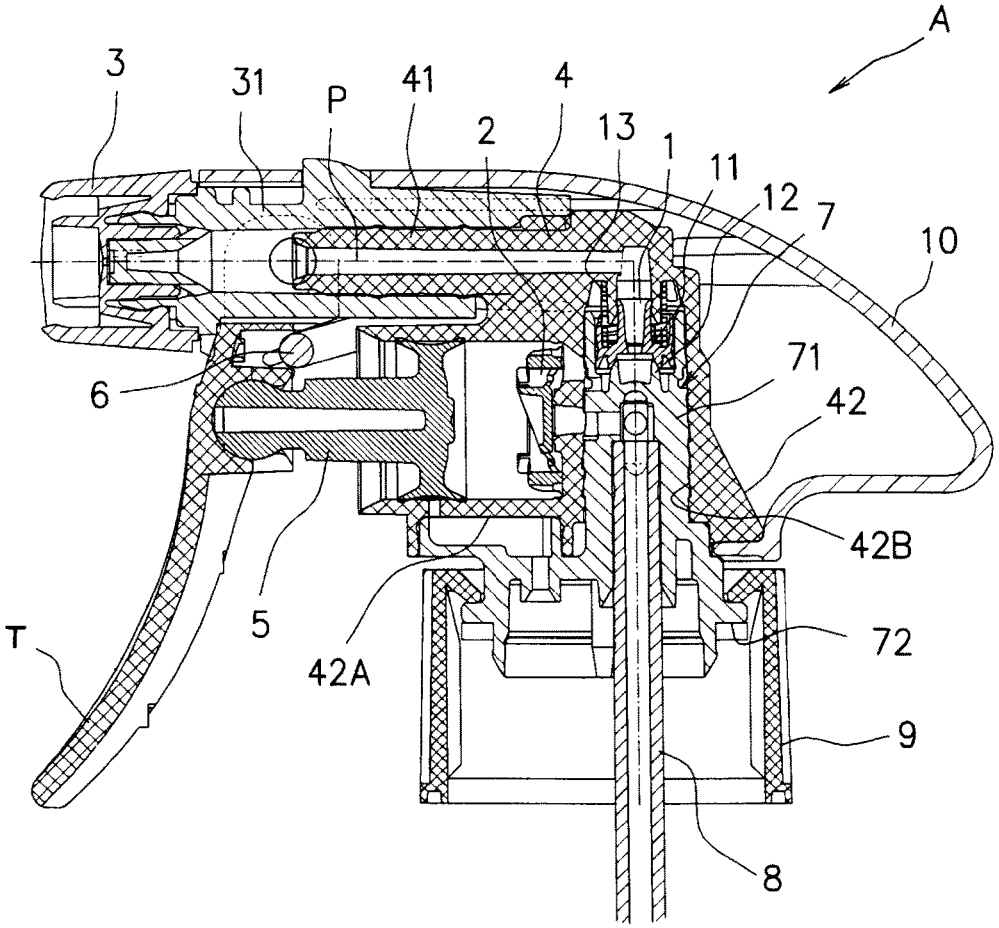
FIG. 1 is an overall longitudinal sectional view in a valve-closed state of a trigger sprayer according to an embodiment of the present invention.
Figure 2:
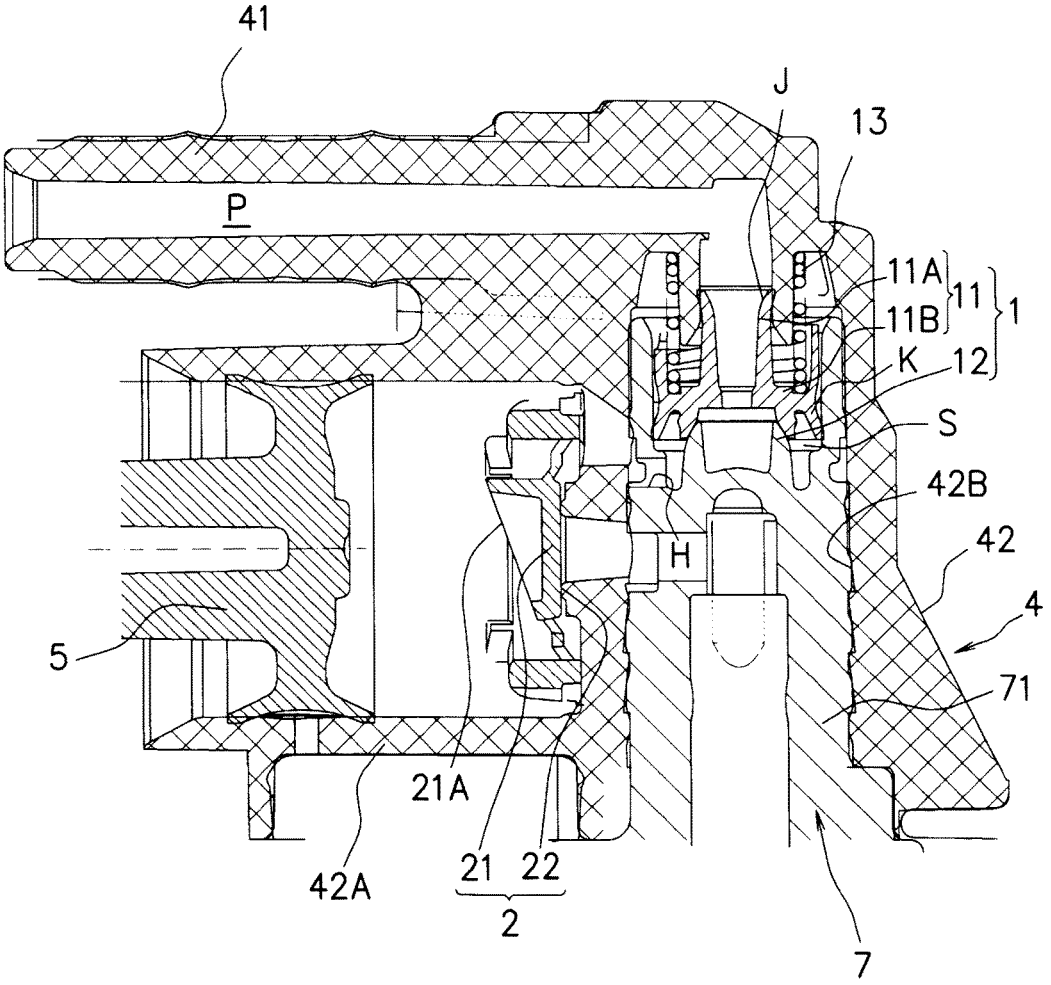
FIG. 2 is an enlarged longitudinal sectional view in a valve-closed state of the main components of a trigger sprayer according to an embodiment of the present invention.

FIG. 1 is an overall longitudinal sectional view in a valve-closed state (S valve) of a trigger sprayer A according to an embodiment of the present invention, and FIG. 2 is an enlarged longitudinal sectional view in a valve-closed state (S valve) of the main components of a trigger sprayer according to an embodiment of the present invention.

Figure 3:
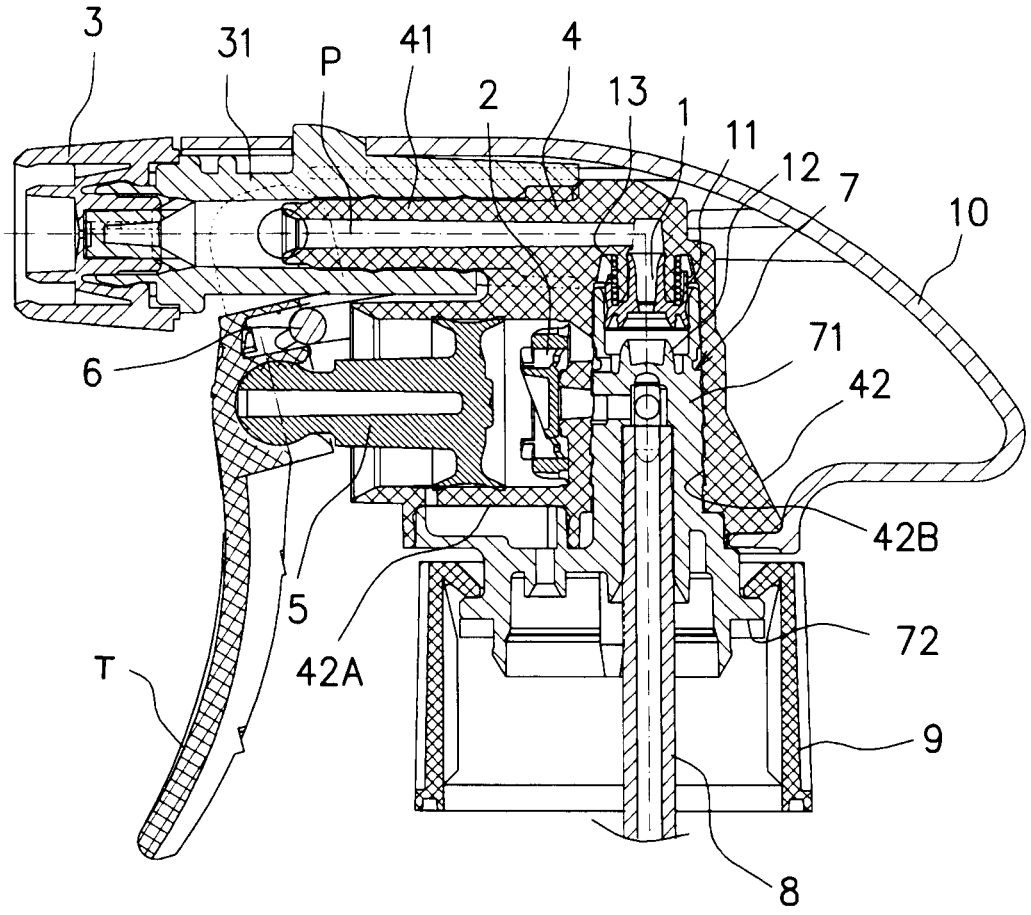
FIG. 3 is an overall longitudinal sectional view in a valve-open state of a trigger sprayer according to an embodiment of the present invention.
Figure 4:
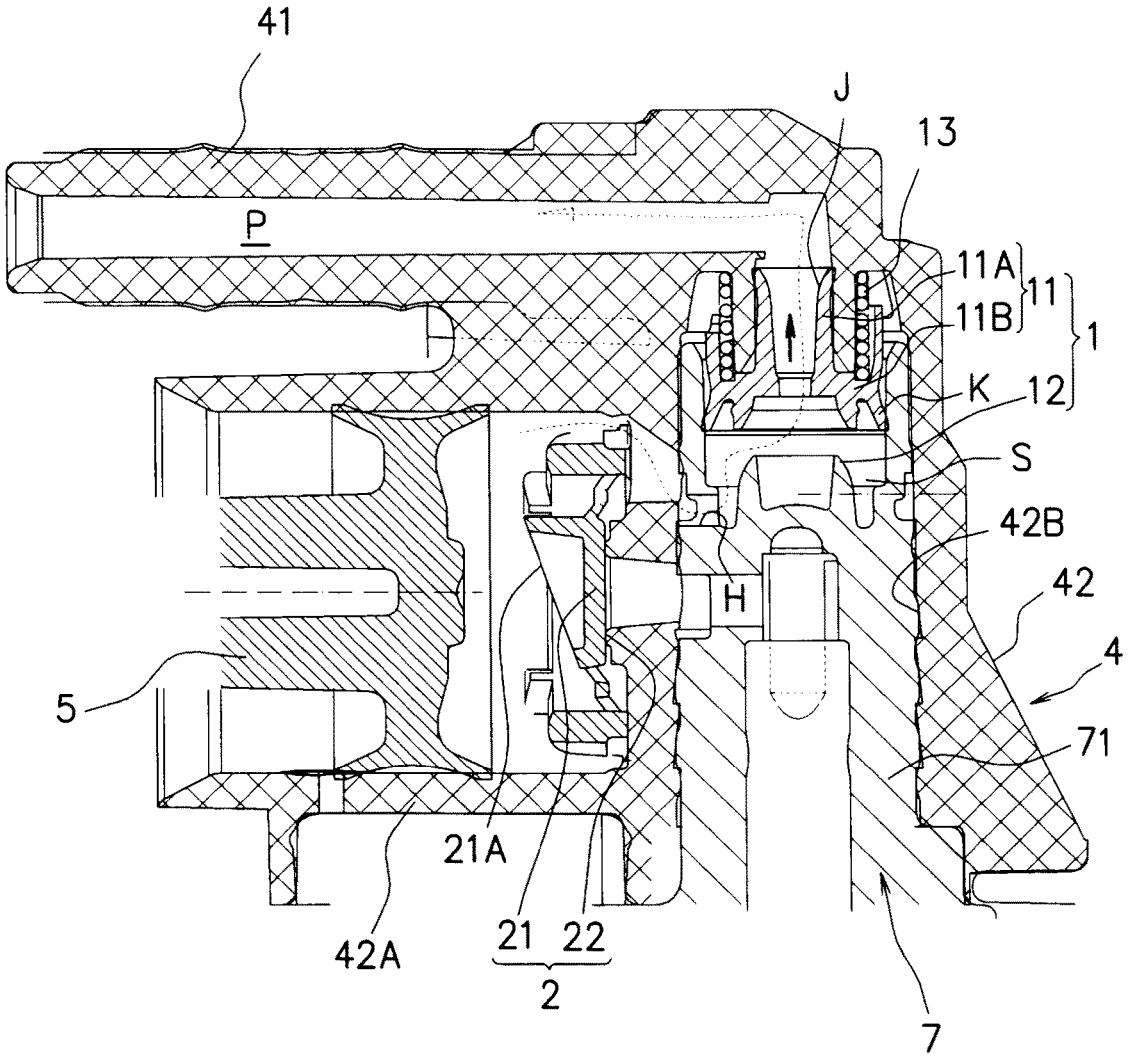
FIG. 4 is an enlarged longitudinal sectional view in a valve-open state of the main components of a trigger sprayer according to an embodiment of the present invention.

Further, FIG. 3 is an overall longitudinal sectional view in a valve-open state (S valve) of a trigger sprayer according to an embodiment of the present invention, and FIG. 4 is an enlarged longitudinal sectional view in a valve-open state (S valve) of the main components of a trigger sprayer according to an embodiment of the present invention.

First, an overview of the trigger sprayer A is provided.

The trigger sprayer A of the present invention is one that, in a state of being attached to a container, causes liquid inside the container to be sprayed from a nozzle part 3 through a passage by rotating a trigger T to move a piston part 5 to apply pressure to liquid inside a cylinder portion 42A of a cylinder structure 4, and includes an F valve 2 provided in a passage between the cylinder portion 42A and the container and an S valve 1 provided in a passage P between the cylinder portion 42A and the nozzle part 3.

As illustrated, the trigger sprayer A has a parts structure including the nozzle part 3, a nozzle base 31, the cylinder structure 4, the piston part 5, the trigger T, a return spring 6, the S valve 1, the F valve 2, a coil spring 13, an attachment base part 7, a tube 8, and a cap 9.

Further, the trigger sprayer A includes a cover body 10 covering the cylinder portion 42A, the nozzle base 31, and the attachment base part 7.

Note here that the nozzle part 3 is attached to the tip of the nozzle base 31 by press fitting and the nozzle base 31 is attached to the front of the cylinder structure 4 by press fitting.

Further, the attachment base part 7 is attached to the bottom of the cylinder structure 4 by press fitting.

The trigger part T is rotatably attached to the nozzle base 31 and is enabled by the return spring 6 to rotate to return.

The following describes each component of the trigger sprayer A.

Figure 5:
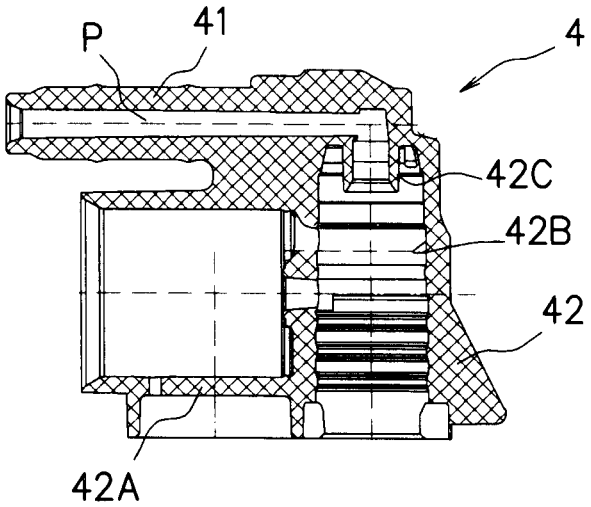
FIG. 5 is an enlarged longitudinal sectional view of a cylinder structure

FIG. 5 is an enlarged longitudinal sectional view of the cylinder structure 4.

First, the cylinder structure 4 includes a base body part 42 and a horizontal part 41 having a horizontal passage P, and the base body part 42 has a vertical columnar hole 42B and the cylinder portion 42A.

The nozzle base 31 is attached to the horizontal part 41 of the cylinder structure 4 by press fitting, and the nozzle part 3 is attached to the tip of the nozzle base 31 by press fitting, Further, the after-mentioned attachment base part 7 is attached to the columnar hole 42B.

A hanging cylindrical portion 42C is formed at an upper end of the columnar hole 42B in a hanging manner, and the S valve 1, which will be described in detail later, is fitted into this hanging cylindrical portion 42C.

Meanwhile, the attachment base part 7 is attached to the mouth of the container via the cap 9.

Figure 6:
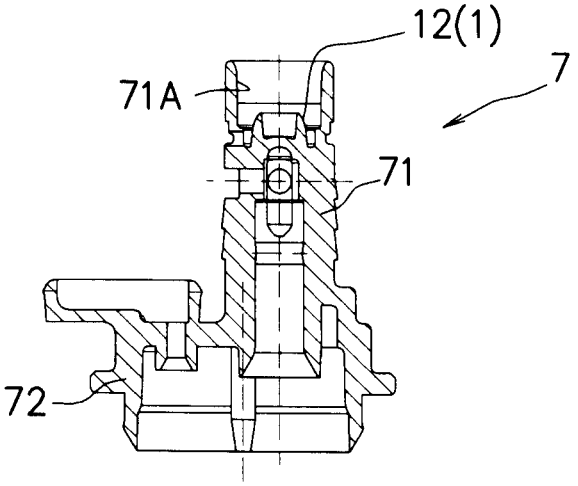
FIG. 6 is an enlarged longitudinal sectional view of an attachment base part.

FIG. 6 is an enlarged longitudinal sectional view of the attachment base part 7.

The attachment base part 7 includes a fixed portion 72 that is attached to the container via the cap 9 and a standing cylindrical portion 71 extending toward a higher position than the fixed portion 72, and this standing cylindrical portion 71 is attached by press fining to the columnar hole 42B formed in the base body part 42 of the aforementioned cylinder structure 4.

In a state where the standing cylindrical portion 71 of the attachment base part 7 is attached to the columnar hole 42B of the base body part 42 of the cylinder structure 4, a space S of a certain area is formed in an upper part of the columnar hole 42B.

The S valve 1 is placed in this space S.

In this case, the part bearing the function of a first valve seat 12 of the S valve 1 is an upper end of the standing cylindrical portion 71.

In particular, the standing cylindrical portion 71 has an upper columnar hole 71A formed at an upper end thereof with an annular projection 12 formed at the bottom of this upper columnar hole 71A, and this annular projection 12 plays the role of the first valve seat 12.

It should be noted the tube 8, which serves as a passage to the container, is fixedly inserted in the standing cylindrical portion 71.

(S Valve Function)

The S valve 1 is described here.

Figure 7:
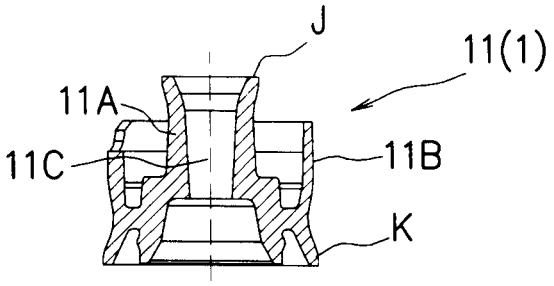
FIG. 7 is an enlarged longitudinal sectional view of a first valve body of an S valve.

FIG. 7 is an enlarged longitudinal sectional view of a first valve body 11 of the S valve 1.

The S valve 1 includes the first valve body 11 and the first valve seat 12.

It should be noted that the role of this first valve seat 12 is played by a portion of the aforementioned attachment base part 7.

The first valve body 11 includes a small-diameter cylindrical part 11A and a large-diameter cylindrical part 11B coupled to an outer side of the small-diameter cylindrical part 11A via a connecting part.

The small-diameter cylindrical part 11A has a gradually-expanded thin-walled increasing diameter portion J formed at the tip thereof, and the large-diameter cylindrical part 11B has two flange portions K.

Such increasing diameter portion J and flange portions K exert a snapping force outward.

Therefore, this small-diameter cylindrical part 11A can stably slide along an inner circumferential surface of the hanging cylindrical portion 42C of the cylinder structure 4.

Meanwhile, the large-diameter cylindrical part 11B can also stably slide along an inner circumferential surface of the upper columnar hole 71A at the head of the standing cylindrical portion 71 of the attachment base part 7.

Further, the coil spring 13 is placed between the cylinder structure 4 and the first valve body 11 of the S valve 1, so that the first valve body 11 is brought into oppressive contact with the first valve seat 12.

It should be noted that this coil spring 13 is fitted onto the circumference of the hanging cylindrical portion 42C of the cylinder structure 4.

(F Valve Function)

The F valve 2 is provided in the passage between the cylinder portion 42A and the container and, in particular, provided at the bottom of the cylinder portion 42A.

This F valve 2 opens when the pressure inside the cylinder portion is reduced when the piston part 5 returns after pressure has been applied to the cylinder portion and liquid inside has squirted outward.

The F valve 2 includes a second valve body 21 and a second valve seat 22, and the role of the second valve seat 22 is played by the annular projection formed at the bottom of the cylinder portion 42A.

At normal times, the second valve body 21 is in oppressive contact with the second valve seat 22, and at valve-open times, the second valve body 21 is out of contact with the second valve seat 22.

This F valve 2 can he said to be the one that serves to disconnect or converge liquid inside the container and liquid inside the cylinder portion 42A.

Further, the second valve body 21 include an inclined surface 21A as an upper surface thereof (i.e. as a surface thereof opposite to the second valve seat 22) and has another function.

The function is effectively fulfilled at a stage where the trigger sprayer is first used after having been attached to the mouth of the container.

At the stage where the trigger sprayer is first used, the cylinder portion 42A does not have liquid inside but has air inside.

This makes it necessary to perform a so-called "air shot" operation to release the air inside the cylinder portion 42A to the outside via the nozzle part 3.

In so doing, since air residing near the F valve 2 will persistently remain, this air is removed from inside the cylinder portion 42A by forcibly opening the F valve 2 by pressing the second valve body 21 with the piston part 5 to purge the air toward the tube 8 (i.e. toward the container).

That is, when the bottom surface of the piston part 5 presses the inclined surface 21A of the second valve body 21, the second valve body 21 rotates so that a part of the second valve body 21 separates from the second valve seat 22.

This forms a space between the second valve body 21 the second valve seat thus forcing the F valve 2 to open.

Thus, the second valve body 21 having the inclined surface 21A is extremely effective when the trigger sprayer A is first used.

For reference, FIGS. 8A to 8F are diagrams explaining the procedure for such an "air shot".

Figure 8A:
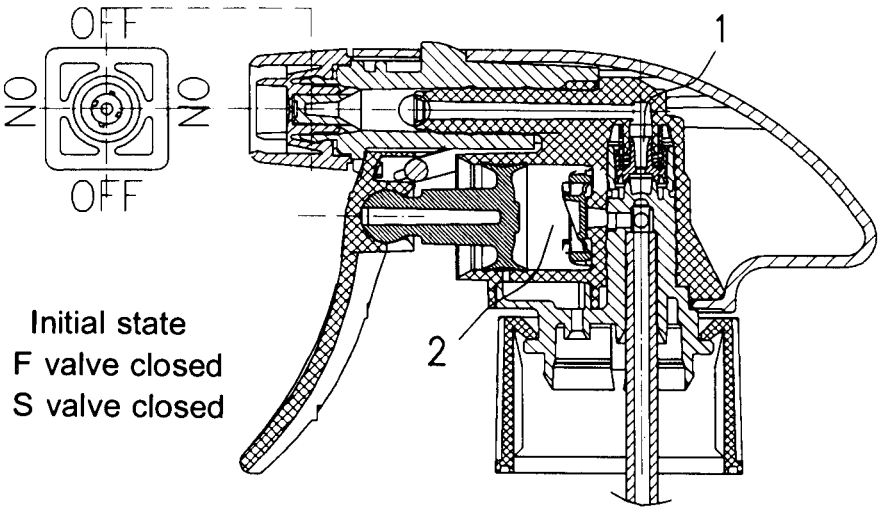
FIG. 8A is a diagram explaining the procedure for an "air shot" and showing a state of first use.

1) When the trigger sprayer is first used after having been attached to the mouth of the container (initial state), both the F valve 2 and the S valve 1 are closed (FIG. 8A).

Figure 8B:
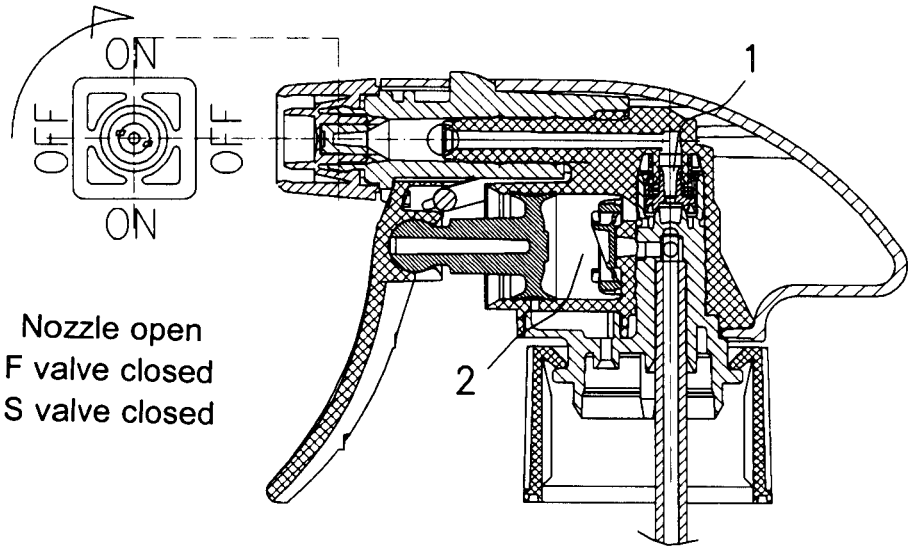
FIG. 8B is a diagram explaining the procedure for an "air shot" and showing a state where a nozzle orifice is open.

From this initial state, the nozzle part 3 is operated to bring the nozzle orifice into an open state (FIG. 8B).

2) Next, the trigger T is pulled to rotate (i.e. the halfway stage of the stroke).

Figure 8C:
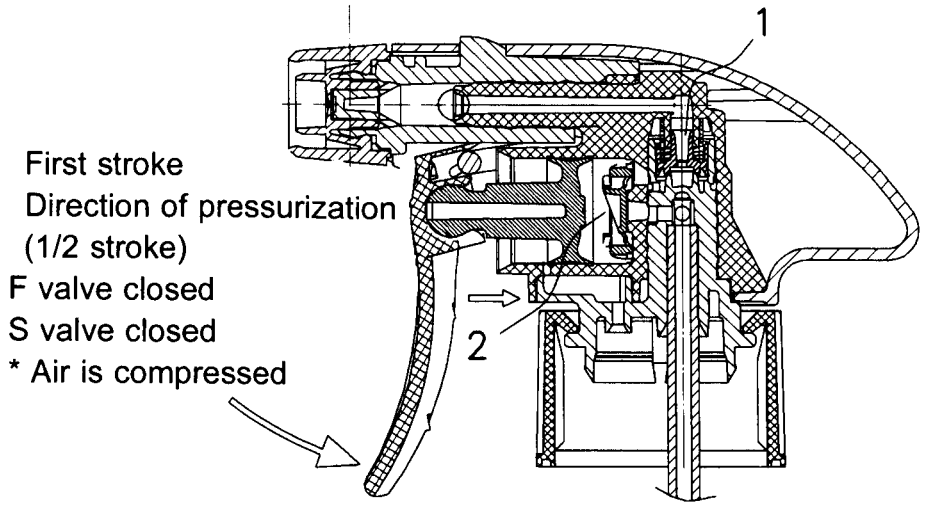
FIG. 8C is a diagram explaining the procedure for an "air shot" and showing a state of a stroke halfway.

At this point in time, both the F valve 2 and the S valve 1 are still closed, and the movement of the piston part 5 causes the air inside the cylinder portion 42A to be compressed (FIG. 8C).

At this point, the air is easily compressed unlike the liquid.

3) Next, the trigger T is rotated until the final stage (i.e. until it is fully pulled) (i.e. a full stroke).

Figure 8D:
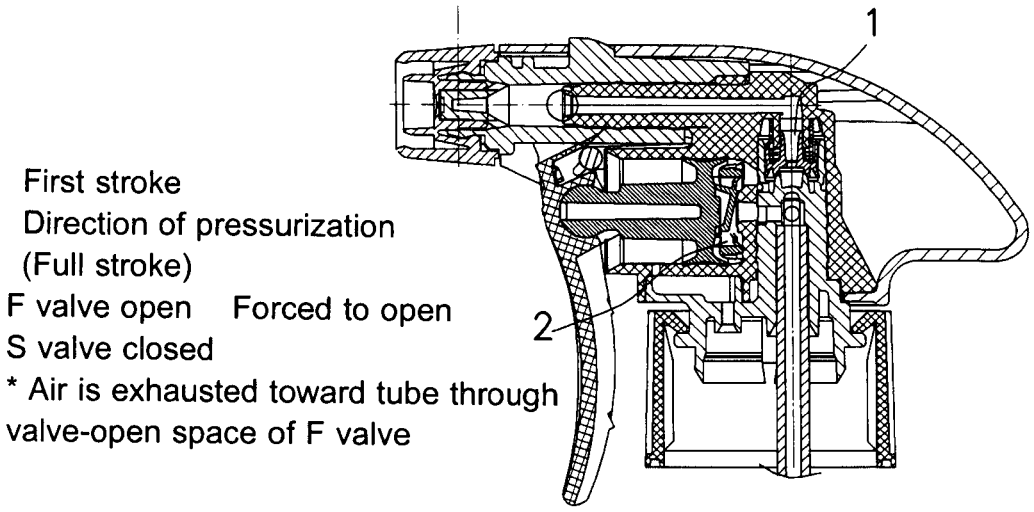
FIG. 8D is a diagram explaining the procedure for an "air shot" and showing a state of a full stroke.

Doing so causes the piston part 5 to press the inclined surface 21A of the second valve body 21 of the F valve 2 (FIG. 8D).

This forces the F valve 2 to open, so that the remaining air escapes from the F valve 2 toward the tube 8.

In particular, when the bottom of the piston part 5 presses the inclined surface 21A of the second valve body 21 of the F valve 2, the second valve body 21 rotates so that a part of the second valve body 21 separates from the second valve seat 22.

This causes the air to he released from the space toward the tube 8.

Figure 8E:
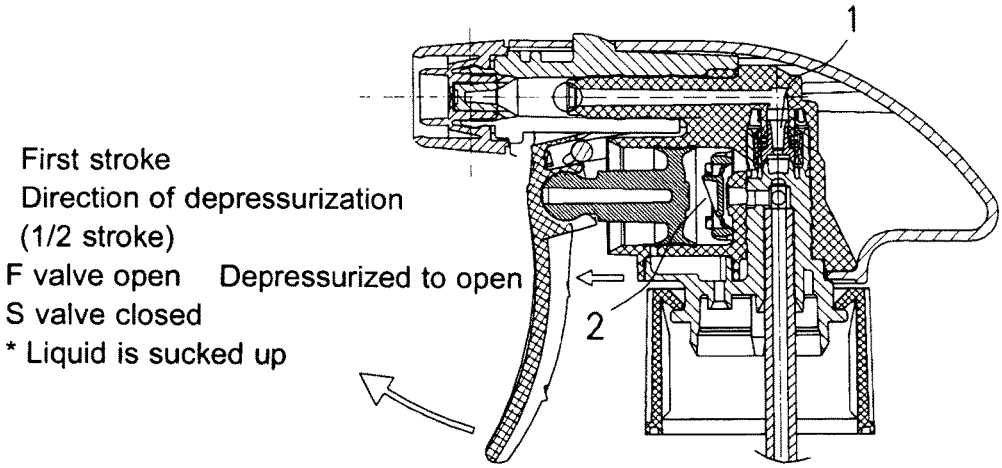
FIG. 8E is a diagram explaining the procedure for an "air shot" and showing a state where a trigger is returning to its original position with the force of resilience.

4) After that, the trigger T rotates so as to return to its original position with the force of resilience thereof, and at this point in time, the movement of the piston part 5 causes the pressure inside the cylinder portion 42A to he reduced, so that the second valve body 21 and the second valve seat 22 separate from each other to form a space and the liquid inside the container is sucked up via the tube 8 (FIG. 8E).

5) Then, once the trigger T completely returns to its original position (initial state), the cylinder portion 42A is filled with liquid.

Figure 8F:
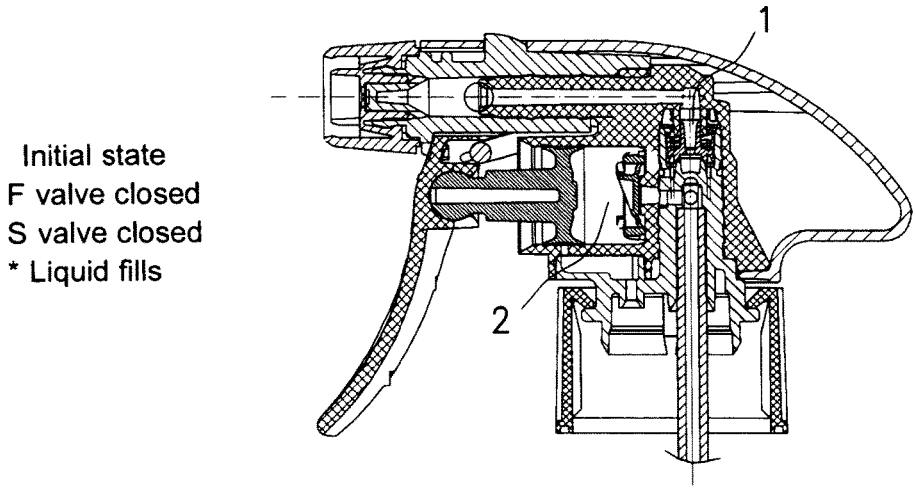
FIG. 8F is a diagram explaining the procedure for an "air shot" and showing a state where the trigger has completely returned to its original position.
Figure 9:
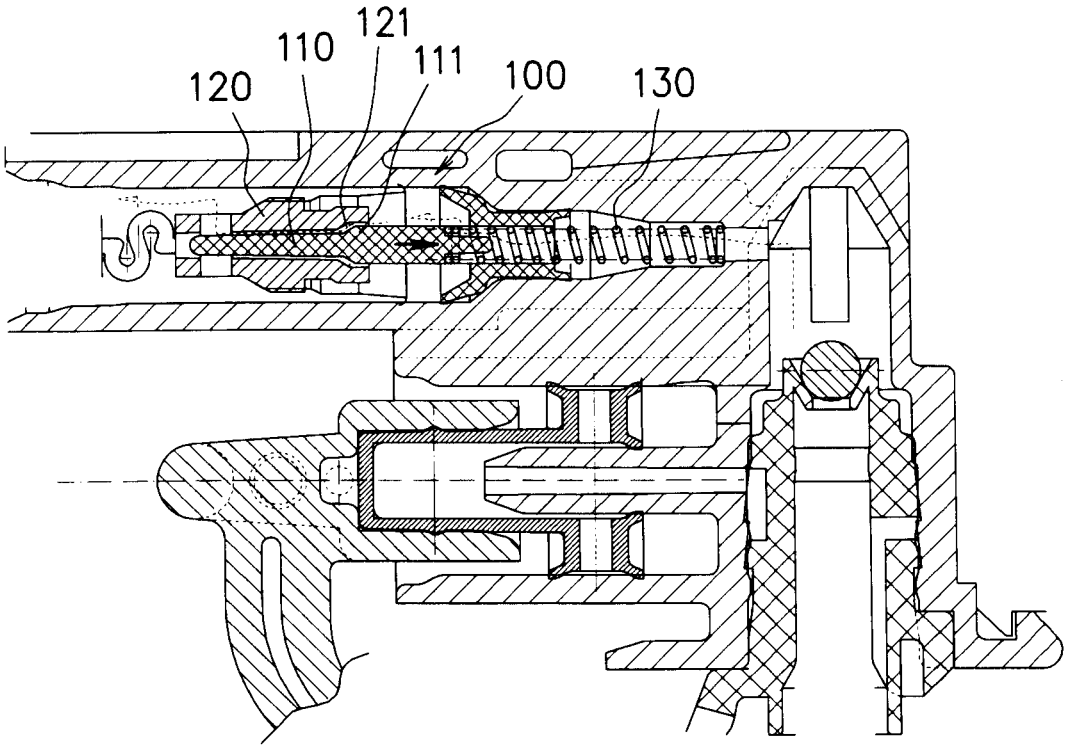
FIG. 9 is an enlarged sectional view of a structure in the vicinity of an S valve in a conventional trigger sprayer.

At this point in time, both the F valve 2 and the S valve 1 close (FIG. 8F).

The following describes the flow of liquid that is sprayed.

Now, suppose that the cylinder portion 42A is filled with liquid.

Pulling the trigger T to cause it rotate and causing the piston part 5 to slide cause pressure to be applied to the liquid inside the cylinder portion 42A, so that the liquid flows into the space S trough a through-hole H.

This applies an upward force to the first valve body 11 of the S valve 1, so that the first valve body 11 separates from the first seat valve 12.

As a result, the S valve 1 opens, so that the liquid flows upward trough a passage hole 11C of the first valve body 11.

Then, the liquid is squirted to the outside through the nozzle part 3.

Note here that when the first valve body 11 moves away from the first valve seat 12 so that the S valve 1 opens, the first valve body 11 moves in the same direction as the direction that the liquid flows.

That is, as indicated by an arrow in FIG. 4, the liquid flows upward and the first valve body 11 moves upward, too.

This prevents a hindrance to the flow of the liquid, thus allowing the liquid to flow downward efficiently.

After that, the liquid is spayed to the outside via the nozzle part 3 from the passage P inside the horizontal part 41.

(Suction)

The following describes the suction of the liquid from the container.

Now, suppose that the liquid has been squirted out through the nozzle part 3 and no liquid remains inside the cylinder portion 42A.

Since the trigger T rotates in an attempt to return to its original position with the force of resilience of the return spring 6, the movement of the piston part 5 causes the pressure inside the cylinder portion 42A to be reduced, so that the F valve 2 opens.

That is, the pressure inside the cylinder portion 42A becomes negative, whereby the second valve body 21 separates from the second valve seat 22.

It should be noted that a plurality of small springs are provided between the circumference of the second valve body 21 and the cylinder portion 42A and pressed against the second valve seat 22.

As a result, the liquid inside the container comes up via the tube 8 and enters the cylinder portion 42A through the F valve 2.

After that, as mentioned above, the procedure for rotating the trigger part to apply pressure to the liquid inside the cylinder portion 42A is repeated.

While a preferred embodiment of the present invention has been described above, the present invention is not limited to the above-described embodiment.

The shapes of the components, such as the cylinder structure 4 and the attachment base part 7, of the trigger sprayer A are subject to design variation within the scope of the purpose, and the same applies to the shapes of the nozzle base 31 and the nozzle part 3.

Further, from the point of view of an assembly operation, such a number of components can of course be adopted that both components are integrated with or divided from each other.

INDUSTRIAL APPLICABILITY

The trigger sprayer A of the present invention includes an S valve in which liquid flows through the cylinder portion 42A with very high efficiency, as the first valve body 11 moves in the same direction as the direction that the liquid flows. The trigger sprayer A of the present invention is thus widely applicable to the field of players including such S valves.

REFERENCE SIGNS LIST

1 . . . S valve

11 . . . First valve body

11A . . . Small-diameter cylindrical part
11B . . . Large-diameter cylindrical part
11C . . . Passage hole
J . . . Increasing diameter portion
K . . . Flange portion
12 . . . First valve seat
13 . . . Coil spring
2 . . . F valve
21 . . . Second valve body
21A . . . Inclined surface
22 . . . Second valve seat
3 . . . Nozzle part
31 . . . Nozzle base
4 . . . Cylinder structure
41 . . . Horizontal part
42 . . . Base body part
42A . . . Cylinder portion
42B . . . Columnar hole
42C . . . Hanging cylindrical portion
5 . . . Piston part
6 . . . Return spring
7 Attachment base part
71 . . . Standing cylindrical portion
71A . . . Upper columnar hole
72 . . . Fixed portion
8 . . . Tube
9 . . . Cap
10 . . . Cover body
A . . . Trigger sprayer
T . . . Trigger
P . . . Passage
H . . . Through-hole
S . . . Space

The invention claimed is:

1. A trigger sprayer for, in a state of being attached to a container, causing liquid inside the container to be sprayed from a nozzle part through a passage by rotating a trigger part to move a piston part to apply pressure to liquid inside a cylinder portion of a cylinder structure, comprising:

an F valve provided in the passage between the cylinder portion and the container; and an S valve provided in a passage section between the cylinder portion and the nozzle part, wherein the S valve includes a first valve body and a first valve seat, the first valve body is elastically pressed against the first valve seat, and when the first valve body moves away from the first valve seat so that the S valve opens, the first valve body moves in the same direction as the direction that the liquid flows, the first valve body of the S valve has a passage hole extending in a central axial direction, the liquid flows through the passage hole, the first valve body includes a small-diameter cylindrical part and a large-diameter cylindrical part coupled to an outer side of the small-diameter cylindrical part via a connecting part, the small-diameter cylindrical part has a gradually-expanded thin-walled increasing diameter portion formed at a tip thereof, and the large-diameter cylindrical part has two flange portions, the cylinder structure is provided with a columnar hole inside which a standing cylindrical portion of an attachment base part that is attachable to the container via a cap is attached, the first valve seat is formed at an upper end of the attachment base part, a hanging cylindrical portion is formed at an upper end of the columnar hole of the cylinder structure in a hanging manner, the increasing diameter portion of the first valve body of the S valve is in slide contact with an inner circumference of this hanging cylindrical portion, the flange portions of the first valve body of the S valve are in slide contact with an inner circumferential surface of the standing cylindrical portion of the attachment base part, and a coil spring that elastically presses the first valve body downward is fitted on a circumference of the handing cylindrical portion.

2. The trigger sprayer according to claim 1, wherein the F valve is provided at a bottom of the cylinder portion and opens by being pressed by the piston part.

3. The trigger sprayer according to claim 2, wherein the F valve includes a second valve body and a second valve seat formed at the bottom of the cylinder portion, and the second valve body has an inclined surface serving as a contact surface that is pressed by the piston part.

* * * * *